US008534793B2

(12) United States Patent
Shinoda

(10) Patent No.: US 8,534,793 B2
(45) Date of Patent: Sep. 17, 2013

(54) LIQUID DISCHARGE APPARATUS AND MAINTENANCE SYSTEM FOR LIQUID DISCHARGE APPARATUS AND METHOD OF MANUFACTURING LIQUID DISCHARGE APPARATUS

(75) Inventor: Akira Shinoda, Obu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/362,563

(22) Filed: Jan. 31, 2012

(65) Prior Publication Data

US 2012/0194606 A1 Aug. 2, 2012

(30) Foreign Application Priority Data

Jan. 31, 2011 (JP) ..... 2011-018955

(51) Int. Cl.
*B41J 2/165* (2006.01)

(52) U.S. Cl.
USPC ..... 347/29

(58) Field of Classification Search
USPC ..... 347/29, 22, 23, 36
See application file for complete search history.

(56) References Cited

U.S. PATENT DOCUMENTS

2007/0285456 A1* 12/2007 Takasu et al. ..... 347/19
2010/0171789 A1* 7/2010 Mun et al. ..... 347/31

FOREIGN PATENT DOCUMENTS

JP 2004-122543 4/2004
JP 2005-212138 * 8/2005

* cited by examiner

*Primary Examiner* — Matthew Luu
*Assistant Examiner* — Michael Konczal
(74) *Attorney, Agent, or Firm* — Scully, Scott, Murphy & Presser, P.C.

(57) ABSTRACT

A liquid discharge apparatus includes a discharge space which faces a discharge surface of a liquid discharge head which is sealed by a cap. A humidification pump is driven to rotate forward such that air in a discharge space is humidified while passing through a water reservoir via an opening and tubes. Humidified air flows into the discharge space via a tube and an opening. When an amount of non-volatile component in the water reservoir exceeds a prescribed amount, the humidification pump is driven to rotate backward such that water stored in the water reservoir is exhausted through the opening via the tubes.

16 Claims, 15 Drawing Sheets

LIQUID DISCHARGE APPARATUS AND MAINTENANCE SYSTEM FOR LIQUID DISCHARGE APPARATUS AND METHOD OF MANUFACTURING LIQUID DISCHARGE APPARATUS

CROSS REFERENCE TO RELATED APPLICATION

This application claims priority from Japanese Patent Application No. 2011-18955, filed on Jan. 31, 2011, the entire subject matter of which is incorporated herein by reference.

TECHNICAL FIELD

The present invention relates to a liquid discharge apparatus which includes a discharge outlet through which a liquid is discharged and to a maintenance system for a liquid discharge apparatus and to a method of manufacturing a liquid discharge apparatus.

BACKGROUND OF THE INVENTION

There has been proposed a technique to let a space inside a cap which airtightly seals a nozzle surface (i.e., a discharge surface) which is opened through nozzles and a water reservoir (i.e., a humidifier liquid reservoir) which contains water (i.e., a humidifier liquid) communicate with each other in order to prevent an increase in viscosity of ink in an inkjet head. With this technique, the cavity inside the cap is filled with air that is humidified with the water contained in the water reservoir.

In the technique described above, if a non-volatile component (e.g., an antiseptic agent) is included in the water replenished in the water reservoir, an amount of the non-volatile component in water reservoir increases during repeated evaporation and replenishment of water in the water reservoir. Therefore, the concentrated non-volatile component in the water reservoir causes deterioration in a steam generating function and, as a result, it becomes impossible to produce humidified air efficiently.

SUMMARY OF THE INVENTION

An object of the present invention is to provide a liquid discharge apparatus that can prevent deterioration in humidifying function caused by an increased amount of non-volatile component in a humidifier liquid reservoir.

A liquid discharge apparatus according to the present invention includes a liquid discharge head which includes a discharge surface forming a plurality of discharge outlets for discharging a liquid. A discharge space is defined as facing the discharge surface. A cap unit is configured to be in a sealed state in which the cap unit seals the discharge space to an external space, and a non-sealed state in which the cap unit does not seal the discharge space to the external space. A humidification mechanism comprises: a humidifier liquid reservoir configured to store an externally supplied humidifier liquid including a non-volatile component, and a humidified air supply unit configured to supply humidified air humidified by a humidifier liquid stored in the humidifier liquid reservoir to the discharge space when it is in the sealed state. A determination unit is configured to determine whether an amount of the non-volatile component in the humidifier liquid stored in the humidifier liquid reservoir is greater than a predetermined amount.

A maintenance system for a liquid discharge apparatus according to the present invention includes a liquid discharge head which includes a discharge surface forming a plurality of discharge outlets for discharging a liquid. A discharge space is defined as facing the discharge surface. A cap unit is configured to be in a sealed state in which the cap unit seals the discharge space to an external space, and a non-sealed state in which the cap unit does not seal the discharge space to the external space. A humidification mechanism comprises: a humidifier liquid reservoir configured to store an externally supplied humidifier liquid including a non-volatile component, and a humidified air supply unit configured to supply humidified air humidified by a humidifier liquid stored in the humidifier liquid reservoir to the discharge space when it is in the sealed state. A determination unit is configured to determine whether an amount of the non-volatile component in the humidifier liquid stored in the humidifier liquid reservoir is greater than a predetermined amount.

A method of manufacturing a liquid discharge apparatus according to the present invention comprising: providing a liquid discharge head which includes a discharge surface, the discharge surface including a plurality of discharge outlets for discharging a liquid, a discharge space being defined facing the discharge surface; providing a cap unit configured to be in a sealed state in which the cap unit seals the discharge space to an external space, and a non-sealed state in which the cap unit does not seal the discharge space to the external space; providing a humidification mechanism comprising: configuring a humidifier liquid reservoir to store an externally supplied humidifier liquid including a non-volatile component; and configuring a humidified air supply unit to supply humidified air humidified by a humidifier liquid stored in the humidifier liquid reservoir to the discharge space when it is in the sealed state; configuring a determination unit to determine whether an amount of the non-volatile component in the humidifier liquid stored in the humidifier liquid reservoir is greater than a predetermined amount.

DESCRIPTION OF THE PREFERRED EMBODIMENTS

Hereinafter, a preferred embodiment of the present invention will be described with reference to the drawings.

An entire configuration of an inkjet printer (hereinafter, "printer") 1 according to an embodiment of the present invention will be described.

Figure 1:
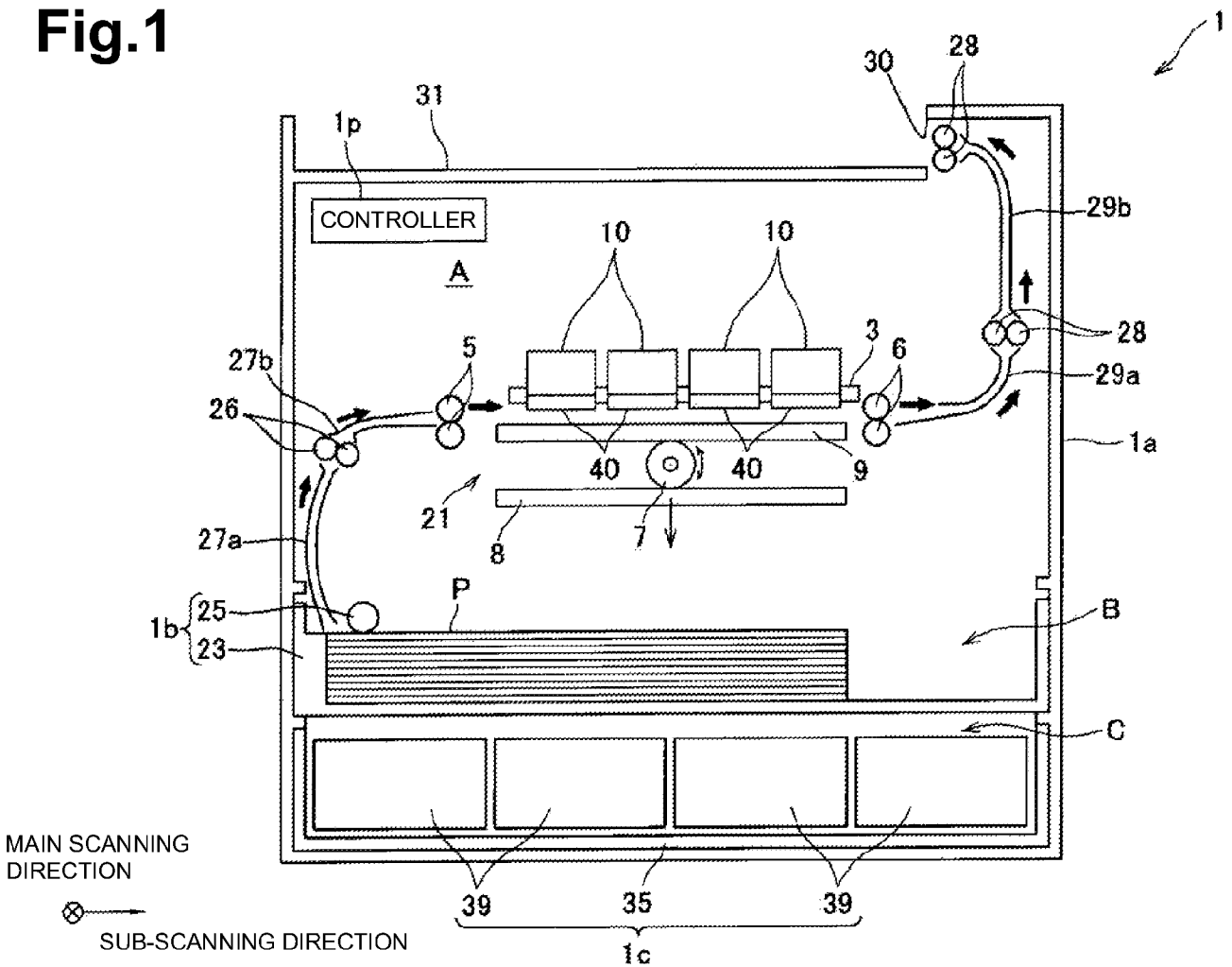
FIG. 1 illustrates, in a schematic side view, an internal structure of an inkjet printer according to an embodiment of the present invention.

As illustrated in FIG. 1, the printer 1 includes a rectangular parallelepiped-shaped housing 1*a*. A paper sheet discharge unit 31 is provided above a top plate of the housing 1*a*. An inner cavity of the housing 1*a* is divided into cavities A, B and C in this order from the top. A paper sheet conveyance path connecting to the paper sheet discharge unit 31 is formed in the cavities A and B. Ink cartridges 39 are placed in the cavity C as ink supply sources to the inkjet head (hereinafter, "head") 10.

Four heads 10, a conveyance unit 21 which conveys a paper sheet P, a guide unit which guides the paper sheet P, a humidification mechanism 50 used for humidification maintenance (see FIG. 5) and other components are placed in the cavity A. A controller 1*p* which controls operations of the components of the printer 1 and manages an operation of the printer 1 is placed in an upper position in the cavity A.

The controller 1*p* controls, in accordance with image data supplied from external device(s), a conveyance operation of the paper sheet P by each component of the printer 1, an ink discharge operation in synchronization with the conveyance of the paper sheet P, a maintenance operation relating to recovery and maintenance of discharge performance, and other operations. The maintenance operation includes flushing, purging, wiping, humidification maintenance, water reservoir cleaning. Flushing is an operation in which actuator(s) of any or all heads 10 are driven in accordance with flushing data that is different from image data so as to compulsorily discharge ink through the discharge outlet 14*a*. Purging is an operation in which ink in the head 10 is pressurized by, for example, a pump so as to compulsorily discharge ink through all the discharge outlets 14*a*. Wiping is an operation in which foreign substances on the discharge surfaces 10*a* are removed with a wiper after the flushing or purging. Humidification maintenance is an operation in which humidified air is supplied to a discharge space S1 (see FIG. 5) which faces the discharge surfaces 10*a*. Water reservoir cleaning will be described below.

The conveyance unit 21 includes a platen 9 and conveyance nip rollers 5 and 6 placed on both sides of the platen 9 in the conveying direction. The conveyance nip rollers 5 and 6 each include a pair of roller members; the roller members face each other to hold the paper sheet P from above and below. The conveyance nip rollers 5 and 6 apply conveying force to the paper sheet P such that the paper sheet P which is being held is conveyed in the conveying direction. The paper sheet P to which conveying force is applied by the conveyance nip roller 5 located in conveying direction upstream is conveyed in the conveying direction while being supported on an upper surface of the platen 9. The conveyance nip roller 6 applies conveying force to the paper sheet P which has passed the upper surface of the platen 9 and conveys the paper sheet P in conveying direction downstream of the platen 9.

An inversion mechanism 7 is placed under the four heads 10. The platen 9 and a glass table 8, which are opposing to each other, are fixed to the inversion mechanism 7. The inversion mechanism 7 moves in a manner that either of the platen 9 or the glass table 8 faces (discharge surfaces 10*a*) of the four heads 10. For example, the inversion mechanism 7 lets the platen 9 face the discharge surfaces 10*a* during printing operation (see FIG. 1). When humidification maintenance or water reservoir cleaning, described below, is carried out in this state, the inversion mechanism 7 moves downward to avoid interference between the platen 9 or the glass table 8 and the discharge surfaces 10*a*, then rotates such that the glass table 8 faces the discharge surfaces 10*a* (see FIGS. 5 and 6) and, after that, moves upward.

Each of the heads 10 is a linear head of substantially rectangular parallelepiped shape extending along the main scanning direction. Each of the heads 10 has the discharge surface 10*a* on a lower surface thereof. Many discharge outlets 14*a* (see FIGS. 3 and 4) are formed on the discharge surfaces 10*a*. During printing operation, black, magenta, cyan and yellow ink is discharged from each one of the discharge surfaces 10*a* of the four heads 10. The four heads 10 are arranged at predetermined intervals along the sub-scanning direction and are supported by the housing 1*a* via a head holder 3. The head holder 3 supports the heads 10 in a manner that the discharge surfaces 10*a* face the platen 9 and that predetermined space suitable for the printing operation is defined between the discharge surfaces 10*a* and the platen 9. The head holder 3 includes ring-shaped caps 40 each of which surrounds an outer periphery of the discharge surface 10*a* of the head 10. Structures of the heads 10 and the head holder 3 will be described in more detail below. The sub-scanning direction is parallel to the conveying direction in which the paper sheet P is conveyed by the conveyance unit 21. The main scanning direction is parallel to the level surface and is perpendicular to the sub-scanning direction.

The guide unit includes an upstream-side guide unit and a downstream-side guide unit placed on both sides of the conveyance unit 21. The upstream-side guide unit includes two guides 27*a* and 27*b*, and a pair of feed rollers 26. The guide unit connects a paper feed unit 1*b* (described later) and the conveyance unit 21. The downstream-side guide unit includes two guides 29*a* and 29*b*, and two pairs of feed rollers 28. The guide unit connects the conveyance unit 21 and the paper sheet discharge unit 31.

The paper feed unit 1*b*, which can be removed from and replaced in the housing 1*a*, is placed in the cavity B. The paper feed unit 1*b* includes a paper sheet feed tray 23 and a paper sheet feed roller 25. The paper sheet feed tray 23 is an upwardly open box-shaped tray which holds paper sheets P of several sizes. The paper sheet feed roller 25 sends the uppermost paper sheet P held in the paper sheet feed tray 23 out and feeds it to the upstream-side guide unit.

As described above, the paper sheet conveyance path extending from the paper feed unit 1*b* to the paper sheet discharge unit 31 via the conveyance unit 21 is formed in the cavities A and B. In response to a print command received from an external device, the controller 1*p* drives a paper sheet feed motor (not illustrated) for the paper sheet feed roller 25, a feed motor (not illustrated) for the feed roller of each guide unit, a conveying motor, and other components. The paper sheet P sent out from the paper sheet feed tray 23 is fed to the conveyance unit 21 by the feed rollers 26. When the paper sheet P passes below each head 10 in the sub-scanning direction, ink is discharged sequentially from the discharge surfaces 10*a* to form a color image on the paper sheet P. The paper sheet P is then conveyed upward by the two feed rollers 28. The paper sheet P is outputed onto the paper sheet discharge unit 31 from an upper opening 30.

An ink unit 1*c* which can be removed from and replaced in the housing 1*a* is placed in the cavity C. The ink unit 1*c* includes a cartridge tray 35, four cartridges 39 placed in parallel on the cartridge tray 35 and a water reservoir 54 (not illustrated; see FIG. 5). Each cartridge 39 supplies ink to a corresponding head 10 via an ink tube (not illustrated).

Next, the structure of the head 10 will be described with reference to FIGS. 2 to 4 and 7. In FIG. 3, pressure chambers 16 and apertures 15 formed below actuator units 17 are illustrated by a solid line which should actually be a dotted line.

Figure 2:
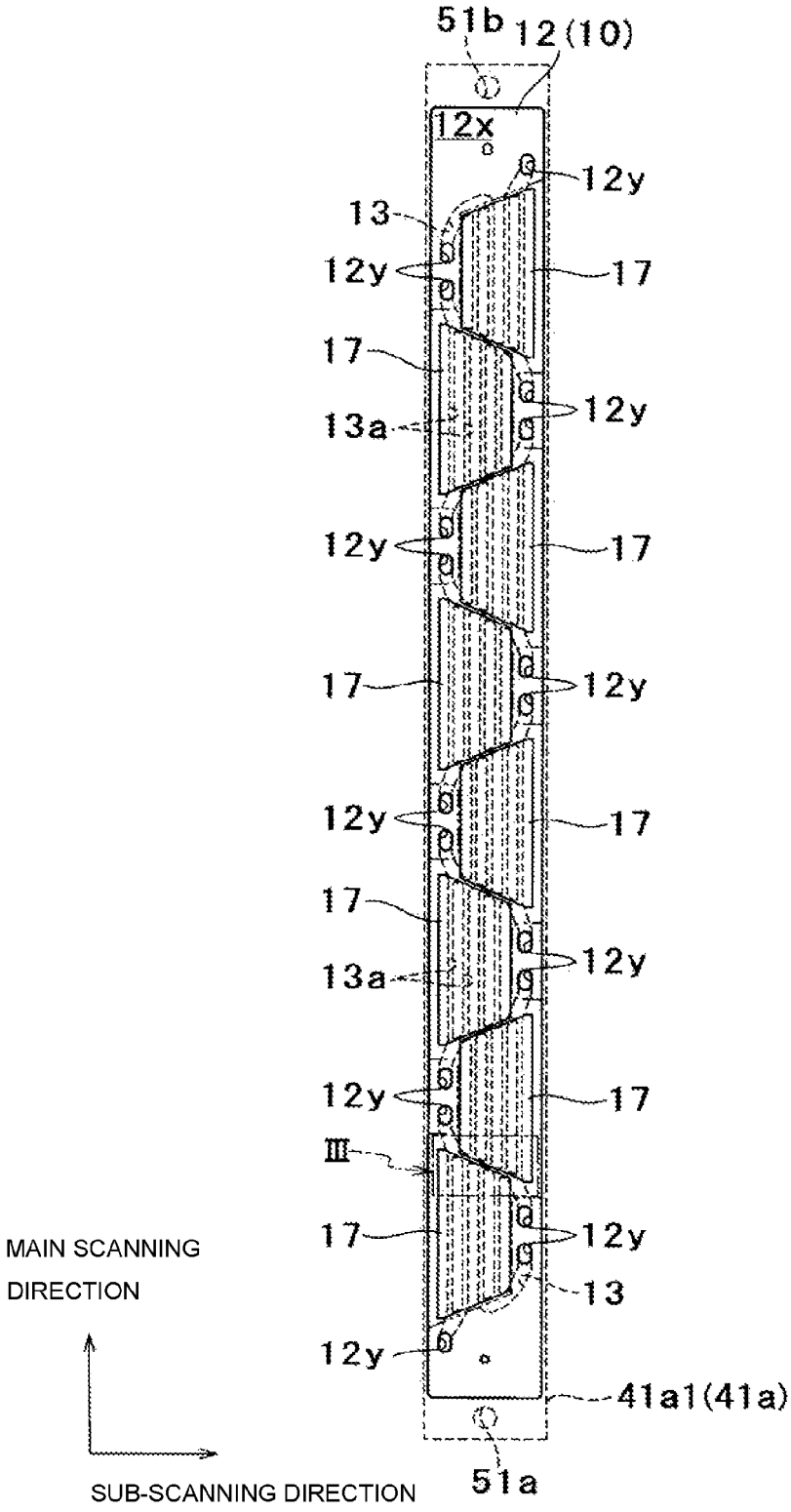
FIG. 2 illustrates, in a plan view, a channel unit and an actuator unit of an inkjet head incorporated in a printer of FIG. 1.
Figure 3:
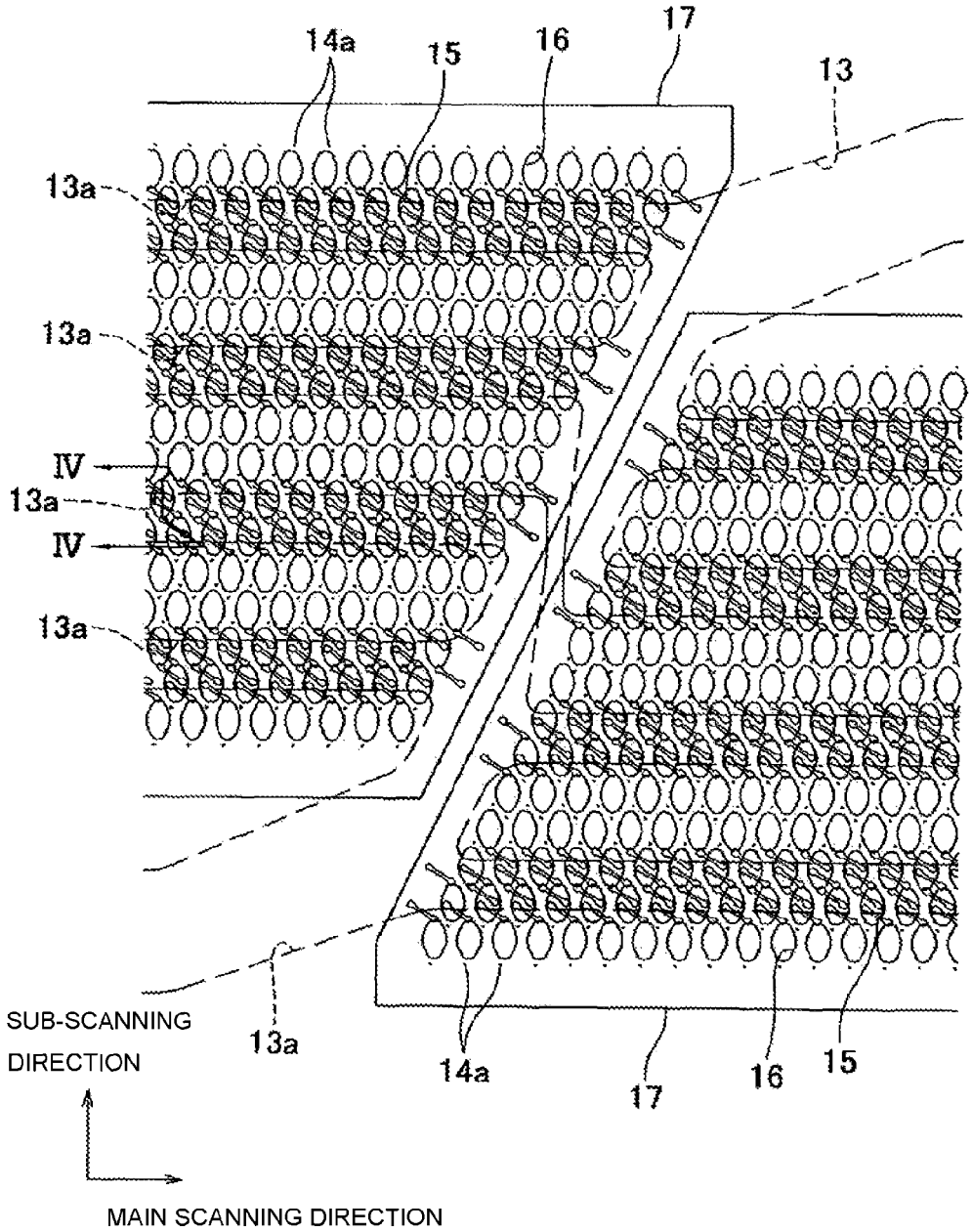
FIG. 3 illustrates, in an enlarged view, an area III defined by a dash-dot line in FIG. 2.
Figure 4:
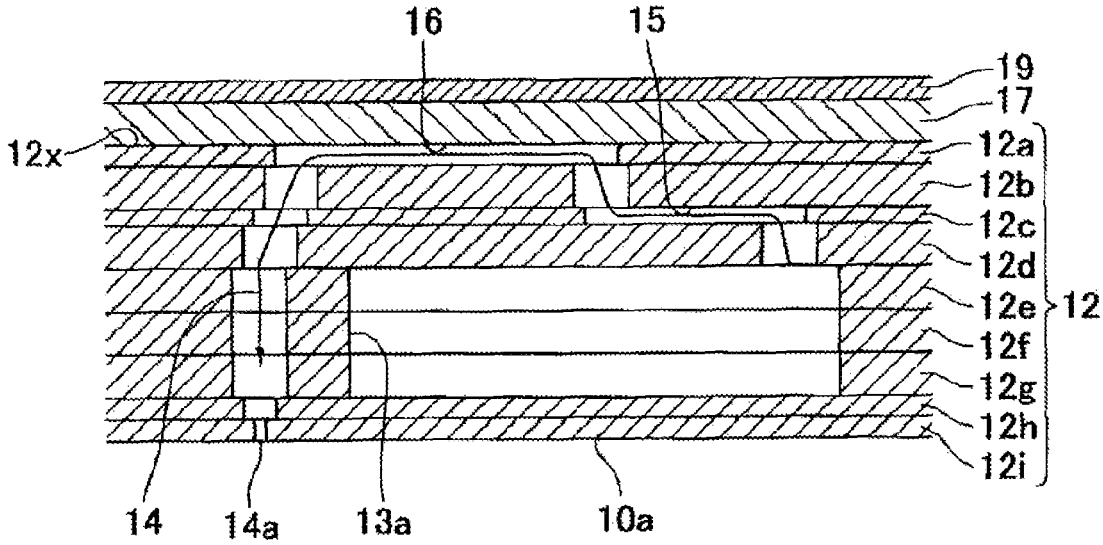
FIG. 4 is a fragmentary sectional view along line IV-IV line of FIG. 3.

As illustrated in FIGS. 2 to 4, the head 10 includes vertically arranged reservoir units 11 (not shown in FIGS. 2 to 4, see FIG. 6) and channel units 12, eight actuator units 17 fixed to upper surfaces 12*x* of the channel units 12, and FPCs connected to each of the actuator units 17. An ink channel including a reservoir which temporarily keeps ink supplied from the cartridges 39 (see FIG. 1) is formed in the reservoir unit 11. An ink channel extending from openings 12*y* on an upper surface 12*x* to each discharge outlet 14*a* on a lower surface (i.e., the discharge surface 10*a*) is formed in the channel unit 12. Each actuator unit 17 includes piezoelectric actuators each corresponding to each of the discharge outlets 14*a*.

Projections and recesses are formed on the lower surface of the reservoir unit 11. The projections are affixed to the upper surface 12*x* of the channel unit 12 at areas in which no actuator unit 17 is provided (i.e., areas defined by dash-dot-dot lines including the openings 12*y* as illustrated in FIG. 2). An end surface of each projection includes an opening connected to the reservoir and facing each opening 12*y* of the channel unit 12. Thus the reservoir and an individual ink channel 14 communicate with each other via the opening described above. The recesses face the upper surface 12*x* of the channel unit 12 and the surface of the actuator unit 17 with a slight gap therebetween.

The channel unit 12 is a layered product of nine rectangular metal plates 12*a*, 12*b*, 12*c*, 12*d*, 12*e*, 12*f*, 12*g*, 12*h* and 12*i* of substantially the same size affixed to each other. The ink channel of the channel unit 12 includes a manifold channel 13 which includes the opening 12*y* at an end, a sub-manifold channel 13*a* branched from the manifold channel 13, and an individual ink channel 14 extending from an outlet of the sub-manifold channel 13*a* to the discharge outlet 14*a* via a pressure chamber 16. As illustrated in FIG. 4, the individual ink channel 14 is formed for each discharge outlet 14*a* and includes an aperture 15 used for channel resistance adjustment. In the adhesive area of each actuator unit 17 on the upper surface 12*x*, substantially diamond-shaped openings are arranged in a matrix so as to expose the pressure chambers 16. In areas which face the adhesive area of each actuator unit 17 on the lower surface (i.e., the discharge surface 10*a*), the discharge outlets 14*a* are arranged in a matrix in the same arrangement pattern as in the pressure chambers 16.

As illustrated in FIG. 2, the actuator units 17 each has a trapezoidal shape and are arranged in two rows of alternate pattern on the upper surface 12*x* of the channel unit 12. Each actuator unit 17 covers the multiple openings of the pressure chambers 16 of formed in the adhesive areas of the actuator unit 17 as illustrated in FIG. 3. Although not illustrated, the actuator unit 17 includes a plurality of piezoelectric layers extending across the multiple pressure chambers 16 and electrodes which hold the piezoelectric layer from above and below in the thickness direction. The electrode includes individual electrodes each corresponding to each of the pressure chambers 16 and a common electrode common to the pressure chambers 16. The individual electrodes are formed on a surface of the uppermost piezoelectric layer.

Various drive signals generated by a control substrate and a driver IC (not illustrated) provided in each head 10 are transferred to the actuator units 17 under the control of the controller 1*p* (see FIG. 1).

Next, a structure of head holder 3 will be described with reference to FIGS. 2, 5 and 6. The head holder 3 is, for example, a metal frame. The cap 40 provided in each head 10 and a pair of joints 51 are attached to the head holder 3.

Figure 5:
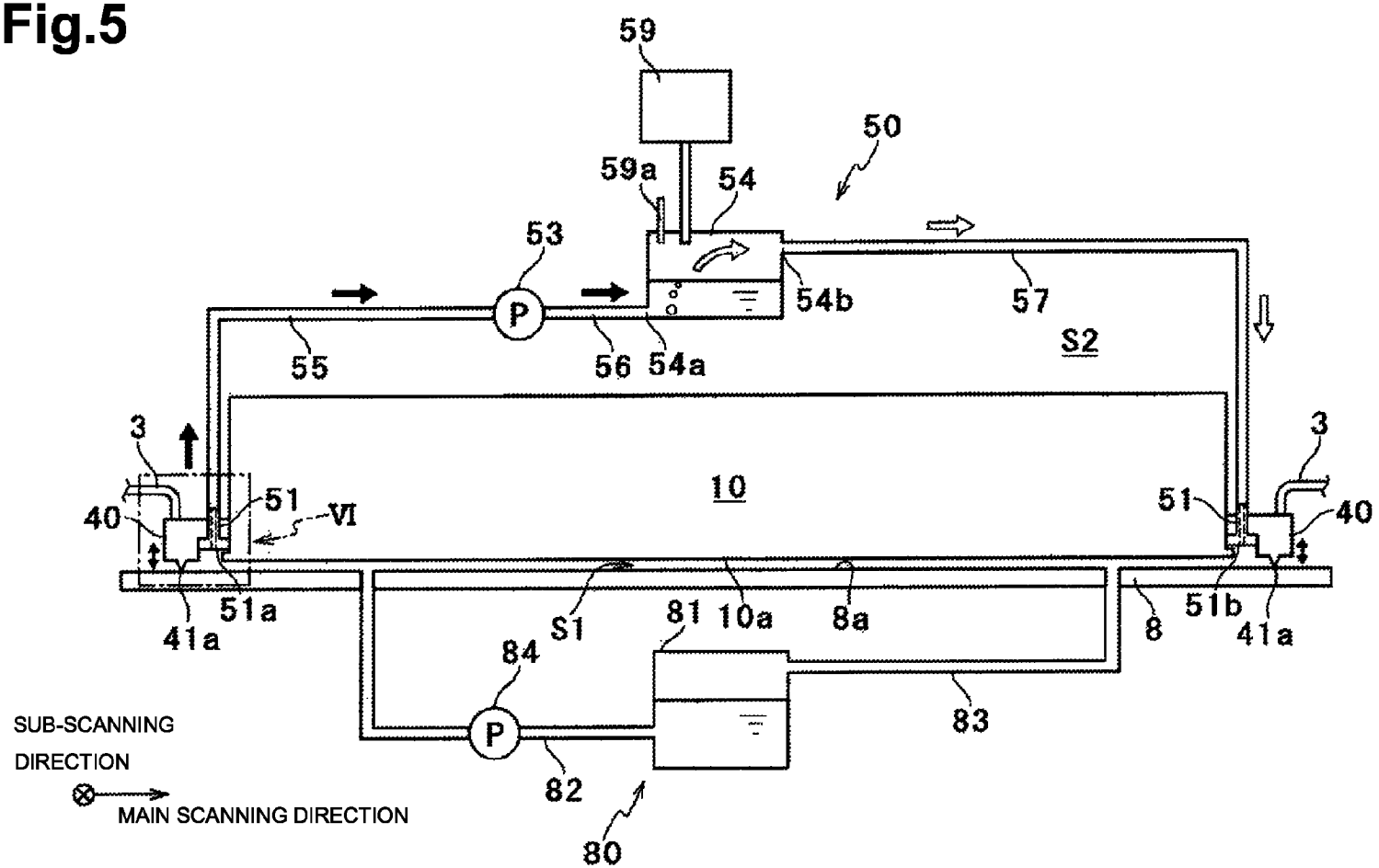
FIG. 5 illustrates, in a schematic diagram, a head holder and a humidification mechanism incorporated in the printer of FIG. 1.

As illustrated in FIG. 5, a pair of joints 51 form one end and the other end of a circulation channel of the humidification mechanism 50. One of the pair of joints 51 is located near one end of the corresponding head 10 and the other is located near the other end of the corresponding head 10 along the main scanning direction. In humidification maintenance, air is collected through an opening (i.e., an exhaust outlet) 51*a* on the lower surface of one of the joints 51 (i.e., the left one in FIG. 5) and humidified air is supplied through an opening (i.e., an inlet) 51*b* on the lower surface of the joint 51 of another side (i.e., the right one in FIG. 5). A valve 52*a* which opens and closes the opening 51*a* is provided near the opening 51*a* and a valve 52*b* which opens and closes the opening 51*b* is provided near the opening 51*b* (see FIG. 8).

Figure 6:
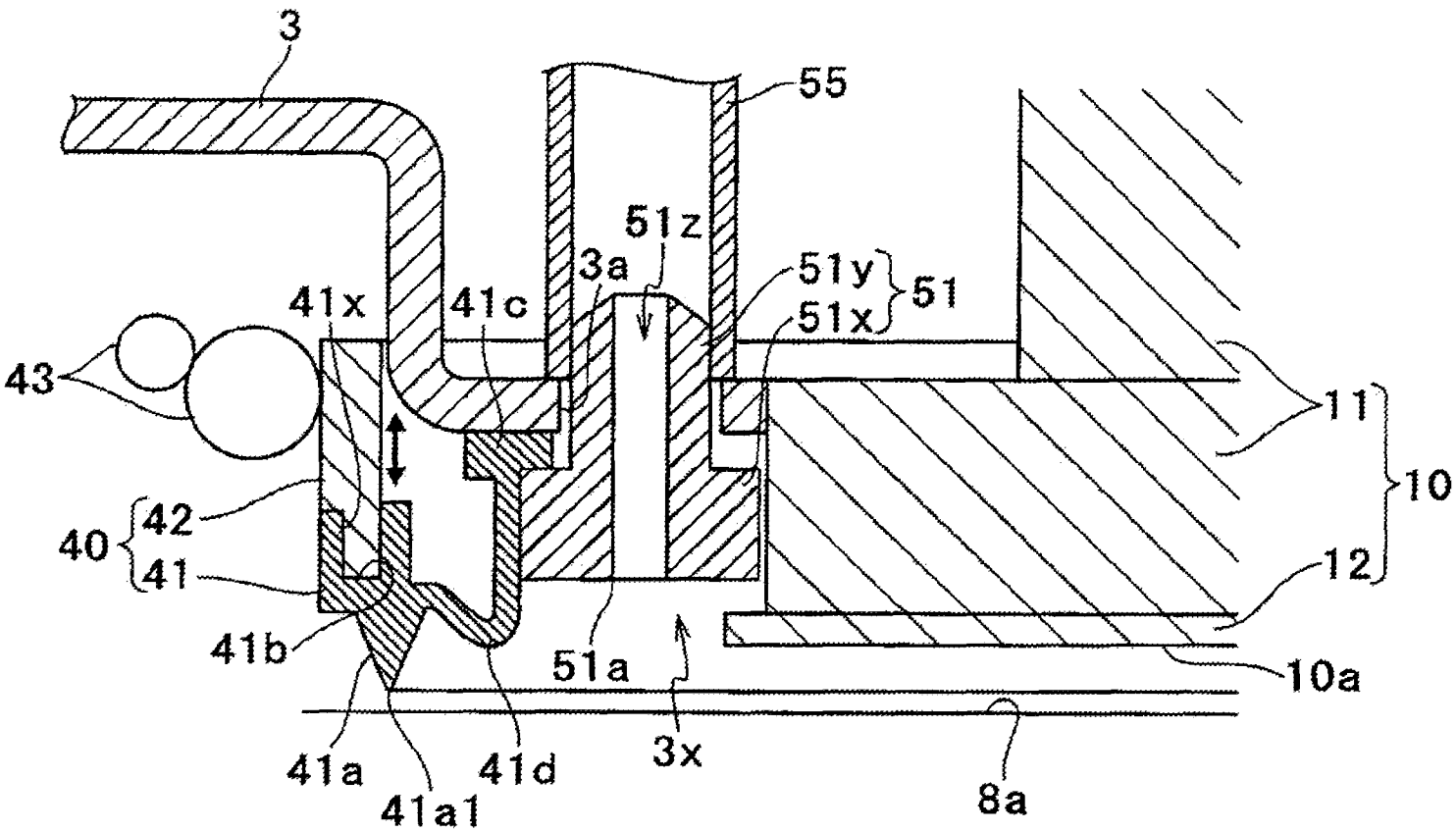
FIG. 6 illustrates, in a fragmentary sectional view, an area VI defined by a dash-dot line in FIG. 5.

As illustrated in FIG. 6, the joint 51 is substantially cylindrical in shape and includes a base end 51*x* and an end 51*y* extending from the base end 51*x*. A hollow cavity 51*z* is formed to extend in a vertical direction from the base end 51*x* to the end 51*y*. The base end 51*x* and the end 51*y* are different in outer diameter: the outer diameter of the base end 51*x* is larger than that of the end 51*y*, but the hollow cavity 51*z* has a constant diameter along the vertical direction. The end 51*y* includes a cut portion along an outer periphery of an upper end surface thereof, and is thus tapered. With this, the tubes 55 and 57 are easily connected, at one end thereof, to the end 51*y*.

The joint 51 is fixed to the head holder 3 in a state in which the end 51*y* is inserted in a through-hole 3*a* of the head holder 3. The through-holes 3*a* are formed at positions at which the joint 51 is fixed to the head holder 3, i.e., both main scanning direction ends of the head 10. The outer diameter of the end 51*y* is slightly smaller than the diameter of the through-hole 3*a*, and therefore a slight gap is formed between an outer peripheral surface of the end 51*y* and a wall surface which defines the through-hole 3*a* of the head holder 3. The gap is sealed by filling, for example, a sealant during fixation of the joint 51 to the head holder 3.

The cap 40 is formed in a ring shape, when seen in a plan view, which surrounds the outer periphery of the discharge surface 10*a* of the head 10. The cap 40 includes an elastic body 41 supported by the head holder 3 via a fixing unit 41*c* and a movable member 42 which can be raised and lowered.

The elastic body 41, formed by an elastic material such as rubber, includes a base 41*x*, a protrusion 41*a*, a fixing unit 41*c* and a connecting unit 41*d*. The protrusion 41*a* is triangular in shape when seen in sectional view and protrudes downward from the lower surface of the base 41*x*. The fixing unit 41*c* is T-shaped when seen in a sectional view and is fixed to the head holder 3. The connecting unit 41*d* connects the base 41*x* and the fixing unit 41*c*. The elastic body 41, which includes the above components, is formed as a ring which surrounds the outer periphery of the discharge surface 10*a* of the head 10 when seen in a plan view. An upper end of the fixing unit 41*c* is fixed to the head holder 3 by, for example, an adhesive. The fixing unit 41*c* is held between the head holder 3 and the base end 51*x* of each joint 51 near each through-hole 3*a*. The connecting unit 41*d* extends outward (in a direction away from the discharge surface 10*a* when seen in a plan view) from the lower end of the fixing unit 41*c* in a curved manner and connects to the lower end of the base 41*x*. The connecting unit 41*d* has flexibility sufficient to be deformed accompanying raising and lowering of the movable member 42. A recess 41*b* which fits the lower end of the movable member 42 is formed on the upper surface of the base 41*x*.

The movable member 42 is formed from a rigid material and is formed as a ring which surrounds the outer periphery of the discharge surface 10*a* of the head 10 when seen in a plan view as in the elastic body 41. The movable member 42 is supported by the head holder 3 via the elastic body 41 and is, at the same time, movable in the vertical direction relative to the head holder 3. In particular, the movable member 42 is connected to a plurality of gears 43 and, under the control of the controller 1*p*, is raised or lowered accompanying rotation of the gears 43 driven by a raising and lowering motor 44 (see FIG. 8). In this state, since the recess 41*b* of the elastic body 41 fits the lower end of the movable member 42, the base 41*x* is also raised or lowered together with the movable member 42. In the elastic body 41, when the movable member 42 is raised or lowered, the base 41*x* including the protrusion 41*a* is raised or lowered together with the movable member 42 in a state in which the fixing unit 41*c* is fixed to the head holder 3. Thus, relative positions between the end 41*a*1 of the protrusion 41*a* and the discharge surface 10*a* change along the vertical direction.

The protrusion 41*a* is selectively located at a contact position and at a separated position accompanying the raising and lowering of the movable member 42. In the contact position, the end 41*a*1 is in contact with a support surface 8*a* of the glass table 8 (i.e., is positioned by the inversion mechanism 7 to face the discharge surface 10*a*) (see FIG. 5). In the separated position, the end 41*a*1 is separated from the support surface 8*a* (see FIG. 6). As illustrated in FIG. 5, when the protrusion 41*a* is in the contact position, the discharge space S1 formed between the discharge surface 10*a* and the support surface 8*a* is separated from the external space S2: the capped (sealed) state. As illustrated in FIG. 6, when the protrusion 41*a* is in the separated position, the discharge space S1 communicates with the external space S2: the non-capped (non-sealed) state.

The protrusion 41*a* is separated from the discharge surface 10*a* along the entire outer periphery of the discharge surface 10*a* (i.e., the lower surface of the head 10 illustrated in FIG. 2) when seen in a plan view. The protrusion 41*a* has a substantially rectangular shape and surrounds the discharge surface 10*a* when seen in a plan view.

Figure 7:
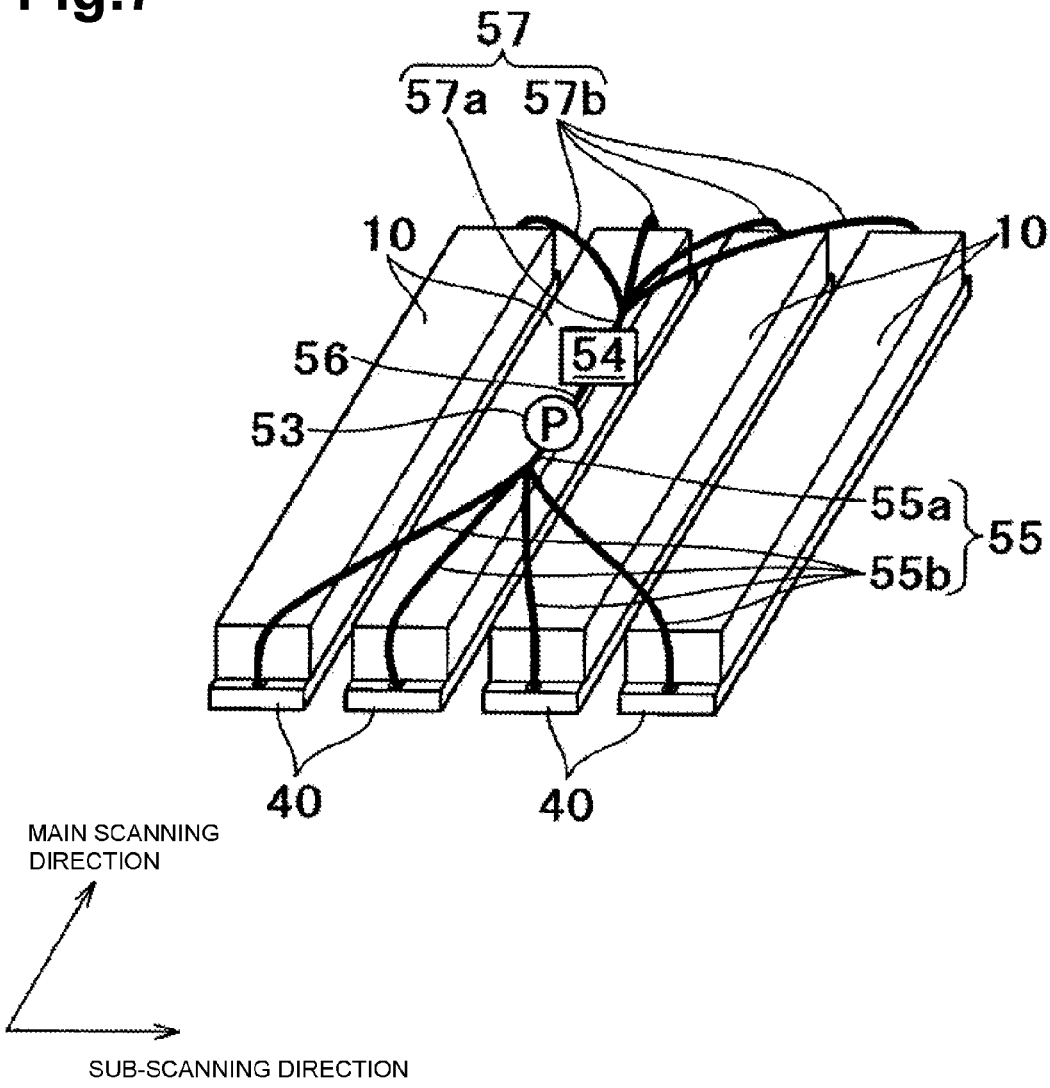
FIG. 7 illustrates, in a schematic diagram, connecting of all the heads and the humidification mechanism incorporated in the printer of FIG. 1.

Next, a structure of the humidification mechanism 50 will be described with reference to FIGS. 5 and 7.

The humidification mechanism 50 includes joints 51, tubes 55, 56 and 57, a humidification pump 53, a water reservoir 54 and a replenishing mechanism 59 as illustrated in FIG. 5. A pair of joints 51 (i.e., two joints) are provided to each head 10. The heads 10 in a printer 1, i.e., four heads 10 share a single humidification pump 53 and a water reservoir 54 as illustrated in FIG. 7. The tubes 55 and 57 each includes main portions 55*a* and 57*a* shared by four heads 10, and four branch units 55*b* and 57*b* branched from the main portion 55*a* and 57*a* and extending to the joints 51. Note that the humidification pump 53 and the water reservoir 54 may be provided in each of the four heads 10.

One end of the tube 55 (i.e., an end of each branch unit 55*b*) fits the end 51*y* of one of the joints 51 (left one in FIG. 5) of each head 10 and the other end (i.e., an end opposite to the branch unit 55*b* of the main portion 55*a*) is connected to the humidification pump 53. That is, the tube 55 connects the hollow cavity 51*z* in one of the joints 51 provided in each head 10 to the humidification pump 53 to provide communication therebetween. The tube 56 connects the humidification pump 53 and the water reservoir 54 to provide communication therebetween. One end of the tube 57 (i.e., an end of each branch unit 57*b*) fits the end 51*y* of the other joint 51 (right one in FIG. 5) of each head 10 and the other end (i.e., an end opposite to the branch unit 57*b* of the main portion 57*a*) is connected to the water reservoir 54. That is, the tube 57 connects the hollow cavity 51*z* of the other joint 51 in each head 10 to the water reservoir 54 to provide communication therebetween.

The water reservoir 54 stores water in a lower space and air in a upper space; the air is humidified by the water in the lower space. The tube 56 is connected to the water reservoir 54 at a position below the water surface; i.e., the tube 56 communicates with the lower space of the water reservoir 54 via an upstream outlet 54*a*. The upstream outlet 54*a* is formed near the bottom surface of the water reservoir 54. The tube 57 is connected to the water reservoir 54 at a position above the water surface; i.e., the tube 57 communicates with the upper space of the water reservoir 54. In humidification maintenance, the humidification pump 53 is driven to rotate forward in the capped state, whereby air in the discharge space S1 is collected through the opening 51*a*. Air collected through the opening 51*a* reaches the humidification pump 53 via the hollow cavity 51*z* of the joint 51, and the cavity in the tube 55, and then reaches the water reservoir 54 via the cavity in the tube 56. The air is supplied to the lower space (i.e., below the water surface) of the water reservoir 54 via the upstream outlet 54*a*. Supplied air is humidified with water in the water reservoir 54 to become humidified air. The humidified air leaves the upper space of the water reservoir 54 through a downstream outlet 54*b* and, via the cavity in the tube 57, flows into the discharge space S1 through the opening 51*b*. Thus, the tubes 55, 56 and 57 form a circulation channel through which humidified air circulates. During stop or forward rotation, the humidification pump 53 functions as a check valve which prevents water in the water reservoir 54 flowing in the direction opposite to that of arrow.

The replenishing mechanism 59 is in communication with a water level sensor 59*a* which detects an amount of remaining water stored in the water reservoir 54 and, when amount of remaining water detected by the water level sensor 59*a* decreases to or below a predetermined amount, the replenishing mechanism 59 replenishes water to the water reservoir 54.

An antiseptic agent which prevents reduction in water quality is added to water to be replenished in the water reservoir 54. For example, as for the antiseptic agent, Ehydroacetic acid, Docosahexaenoic acid, Potassium benzoate, 2-Pyridinethiol, 1-Oxide sodium, 1,2-Benzisothiazol-3-one, etc. correspond. Since the antiseptic agent includes a non-volatile component, an amount of the non-volatile component in the water reservoir 54 increases during repeated evaporation and replenishment of water. Therefore, the concentrated non-volatile component in the water reservoir 54 causes deterioration in a steam generating function and, as a result, it becomes impossible to produce humidified air efficiently. To avoid this phenomenon, when the amount of the non-volatile component in the antiseptic agent included in the water reservoir 54 increases to a prescribed amount ("prescribed amount") or greater, water reservoir cleaning is performed to remove the non-volatile component in the antiseptic agent included in the water reservoir 54. The prescribed amount is smaller than an amount at which the concentrated non-volatile component causes deterioration in steam generating function. In water reservoir cleaning, after the state is shifted to the capped state, the humidification pump 53 is driven to rotate forward. Thus, water is agitated by the air compulsorily supplied to the water reservoir 54 and the non-volatile component in the antiseptic agent deposited on the bottom surface starts floating. Then, the humidification pump 53 is driven to rotate backward to cause the non-volatile component in the antiseptic agent is exhausted with water into the discharge space S1 through the opening 51*a*. The water reservoir 54 is emptied in the present embodiment. However, in an alternative embodiment, a certain amount of water may be exhausted so that the rest of water remains in the water reservoir 54. After water is exhausted, the replenishing mechanism 59 replenishes water in the water reservoir 54.

A recovering mechanism 80 is provided on the glass table 8. The recovering mechanism 80 includes a waste liquid reservoir 81, tubes 82 and 83 and a recovery pump 84. The tubes 82 and 83 are each connected to the waste liquid reservoir 81 and the glass table 8 so that the waste liquid reservoir 81 and the discharge space S1 communicate with each other. The recovery pump 84 is provided in the tube 82. In water reservoir cleaning, after the water exhausted through the opening 51*a* is collected in the discharge space S1, the recovery pump 84 is driven such that the water liquid collected in the discharge space S1 is collected in the waste liquid reservoir 81 via the tube 82. At this time, air in the waste liquid reservoir 81 is supplied to the discharge space S1 via the tube 83. Therefore, the waste liquid collected in the discharge space S1 can be recovered smoothly.

Figure 8:
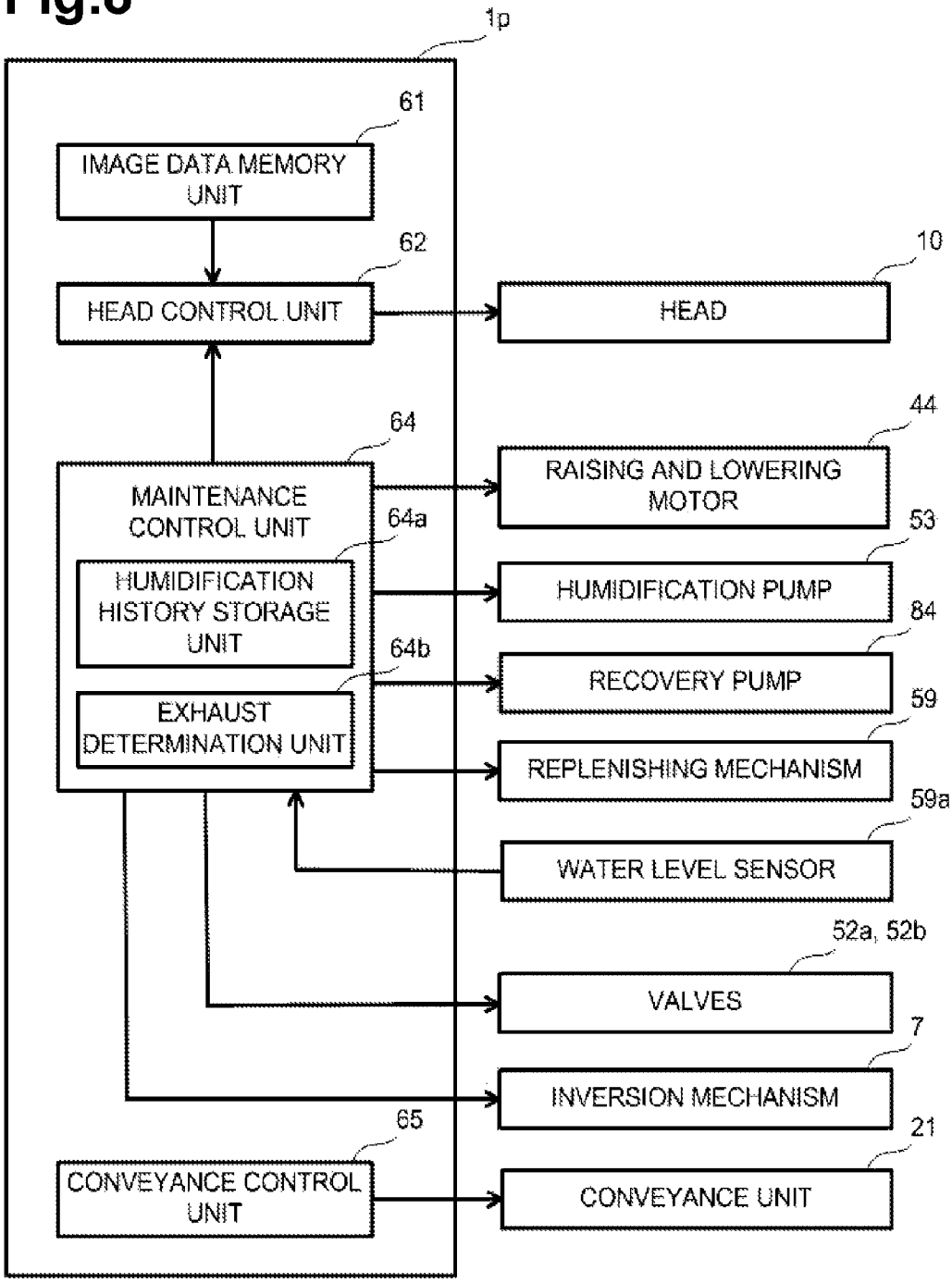
FIG. 8 illustrates, in a functional block diagram, a controller incorporated in the printer of FIG. 1.

Next, the controller 1*p* will be described. The controller 1*p* includes a central processing unit (CPU), non-volatile memory and random access memory (RAM). Programs executed by the CPU and data used by the programs are rewritably stored in the non-volatile memory. During the execution of the program, data is temporarily stored in the RAM. Each of the function units of the controller 1*p* is cooperatively formed by the hardware and the software in the non-volatile memory. As illustrated in FIG. 8, the controller 1*p* includes an image data memory unit 61, a head control unit 62, a maintenance control unit 64 and a conveyance control unit 65.

The image data memory unit 61 stores image data representing an image to be printed on the paper sheet P. The conveyance control unit 65 controls the conveyance unit 21 such that the paper sheet P is conveyed along the conveying path at a predetermined speed. The head control unit 62 controls the head 10 such that the image related to the image data stored in the image data memory unit 61 is printed on the paper sheet P which is conveyed by the conveyance unit 21 and that flushing is performed in the maintenance operation.

The maintenance control unit 64 controls the inversion mechanism 7, the humidification pump 53 of the humidification mechanism 50, the raising and lowering motor 44 which raises and lowers the movable member 42 (i.e., the end 41*a*1 of the protrusion 41*a*) and the recovery pump 84, and the valves 52*a* and 52*b* such that humidification maintenance or water reservoir cleaning is performed. When the amount of remaining water detected by the water level sensor 59*a* decreases to or below a predetermined amount, the maintenance control unit 64 controls the replenishing mechanism 59 such that water is replenished to the water reservoir 54.

The humidification maintenance, in which humidified air is supplied to the discharge space S1 in a capped state, is started when predetermined time elapsed since the latest printing operation is completed.

When the humidification maintenance is started, the maintenance control unit 64 controls the inversion mechanism 7 such that the support surface 8*a* of the glass table 8 faces the discharge surfaces 10*a*. The movable member 42 is then moved downward by the rotation of the gears 43. The protrusion 41*a* is in the separated position (see FIG. 6) during the printing operation and, is moved to the contact position accompanying downward movement of the movable member 42 (see FIG. 5). Therefore, the discharge space S1 is sealed and the state is shifted to a capped state (YES at S1 in FIG. 9). In a standby state or idle state in which no printing operation is carried out, the maintenance control unit 64 moves the protrusion 41*a* to a contact position and the state is shifted to a capped state. The maintenance control unit 64 then opens the openings 51*a* and 51*b* with the valves 52*a* and 52*b*.

Subsequently, the maintenance control unit 64 drives the humidification pump 53 (S2) and collects air in the discharge space S1 through the opening 51*a* of one of the joints 51. Here, air collected through the opening 51*a* reaches the humidification pump 53 via the hollow cavity 51*z* of the joint 51 and the cavity in the tube 55, and then reaches the water reservoir 54 via the cavity in the tube 56. The air is supplied to the lower space (i.e., below the water surface) of the water reservoir 54 through the upstream outlet 54*a*. The humidified air humidified by the water in the water reservoir 54 is exhausted from the upper space of the water reservoir 54 through the downstream outlet 54*b*. At this time, humidity of humidified air exhausted from upper space of water reservoir 54 serves as value near 100%. The humidified air is supplied to the discharge space S1 via the cavity in the tube 57 and through the opening 51*b* of the other of the joints 51. Black arrows in FIG. 5 represent the flow of air before the humidification and white arrows represent the flow of air after the humidification. The maintenance control unit 64 controls switch valves (not illustrated) provided in the branch units 55*b* and 57*b* illustrated in FIG. 7 in addition to the driving of the humidification pump 53 so as to selectively adjust the flow of air in the branch units 55*b* and 57*b*.

When the humidified air is thus supplied to the discharge space S1 through the opening 51*b*, humidity in the discharge space S1 increases and, as a result, viscosity of the concentrated ink at the discharge outlet 14*a* decreases. In a balanced state, it is only necessary that humidity of the humidified air is equal to or greater than the ambient humidity; and it is preferred that humidity of air is, in a balanced state, is equivalent to or greater than the proper humidity at which ink viscosity at the discharge outlet 14*a* is suited to discharging ink. At the completion of supply of the humidified air (S3), feed time (equivalent to driving time of the humidification pump 53) is stored in a humidification history storage unit 64*a* (S4). Now, the humidification maintenance is completed.

Upon reception of a print command, the maintenance control unit 64 drives the gears 43 to move the movable member 42 upward and thereby the protrusion 41*a* are moved to the separated position from the contact position. Then, the maintenance control unit 64 controls the inversion mechanism 7 such that the platen 9 faces the discharge surfaces 10*a*. Now the printer 1, it is ready for printing. In a standby state or idle state after the printing operation is completed, the maintenance control unit 64 controls the inversion mechanism 7 such that the support surface 8*a* of the glass table 8 faces the discharge surface 10*a*, and then lets the movable member 42 move downward to thereby move the protrusion 41*a* to the contact position from the separated position, whereby the state is shifted to the capped state.

Water reservoir cleaning is performed to exhaust the non-volatile component in the water reservoir 54 with water after the exhaust determination unit 64*b* determines that the amount of the non-volatile component in the antiseptic agent stored in the water reservoir 54 is greater than a prescribed amount and immediately before replenishment of water is started by the replenishing mechanism 59 in response that the amount of remaining water in the water reservoir 54 decreases to or below a predetermined amount (preferably ¼, 1/10, and so on of the total capacity of the water reservoir 54, S6). The exhaust determination unit 64*b* determines, with reference to the humidification history storage unit 64*a*, that the amount of the non-volatile component in the water is greater than a prescribed amount each time a predetermined amount (predetermined time) of humidified air is supplied (S5). Moisture in the humidification air is absorbed into the ink in a discharge outlet 14*a*. Therefore, the driving time of the humidification pump 53 and the amount of consumption of the water in the water reservoir 54 (equivalent to the amount of supply of water to the water reservoir 54) is proportionally related. The predetermined time is set to reflect when the amount of the non-volatile component in the water is greater than a prescribed amount.

When the water reservoir cleaning is started (S7), the maintenance control unit 64 controls the inversion mechanism 7 as in the humidification maintenance such that the support surface 8*a* of the glass table 8 faces the discharge surfaces 10*a*, and then drives the gears 43 to rotate so as to move the movable member 42 downward, whereby the state is shifted to the capped state. The maintenance control unit 64 drives the humidification pump 53 to rotate forward. Thus, water is agitated by the air compulsorily supplied to the water reservoir 54 and the non-volatile component deposited on the bottom surface starts floating. Subsequently, the opening 51*a* is opened by the valve 52*a* and the opening 51*b* is closed by the valve 52*b*, and the humidification pump 53 is driven to rotate backward. Therefore, the total amount of the non-volatile component in the water reservoir 54 is exhausted into the discharge space S1 through the opening 51*a* with water. Water exhausted through the opening 51*a* is recovered by the recovering mechanism 80. The maintenance control unit 64 lets the valve 52*a* close the opening 51*a* after the exhaust of water through the opening 51*a* is completed. Now, water reservoir cleaning is completed. During water reservoir cleaning, the water liquid reservoir 81, the water reservoir 54 or other liquid paths are made to communicate with ambient air, thereby promoting movement of water. After water reservoir cleaning is completed, the feed time which is stored in a humidification history storage unit 64*a* is reset (S8), and replenishment of water is performed by the replenishing mechanism 59 (S9).

As described above, water stored in the water reservoir 54 is exhausted when the amount of the non-volatile component is greater than a prescribed amount. Therefore, the printer 1 according to the present embodiment can prevent deterioration in humidifying function caused by an increased amount of non-volatile component in the water reservoir 54.

The exhaust determination unit 64*b* determines, with reference to the humidification history storage unit 64*a*, that the amount of the non-volatile component in the antiseptic agent included in the water is greater than a prescribed amount each time a predetermined amount of humidified air is supplied. Thereby, it is determined whether the amount of the non-volatile component is greater than a prescribed amount.

Water reservoir cleaning is started after the exhaust determination unit 64*b* determines that the amount of the non-volatile component is greater than a prescribed amount and immediately before replenishment of water by the replenishing mechanism 59 is started in response that the amount of the remaining water in the water reservoir 54 decreases to or below the predetermined amount. As a result, water is exhausted with the concentrated non-volatile component and is then replenished. Therefore, waste of replenished water can be reduced.

In addition, water stored in the water reservoir 54 is exhausted through the upstream outlet 54*a* provided near the bottom surface of the water reservoir 54, whereby water in the water reservoir 54 is exhausted efficiently.

In humidification maintenance, the circulation channel through which the humidified air circulates is formed, whereby water consumption is reduced.

In addition, humidified air can be produced in a simple structure in which air is supplied compulsorily through the upstream outlet 54*a* which is in contact with water in the water reservoir 54.

In water reservoir cleaning, the humidification pump 53 is driven to rotate forward immediately before the non-volatile component is exhausted with water, and thus water is agitated by the air compulsorily supplied to the water reservoir 54 so that the non-volatile component deposited on the bottom surface starts floating. As a result, the non-volatile component deposited on the bottom surface can be exhausted efficiently.

Modification

Figure 9:
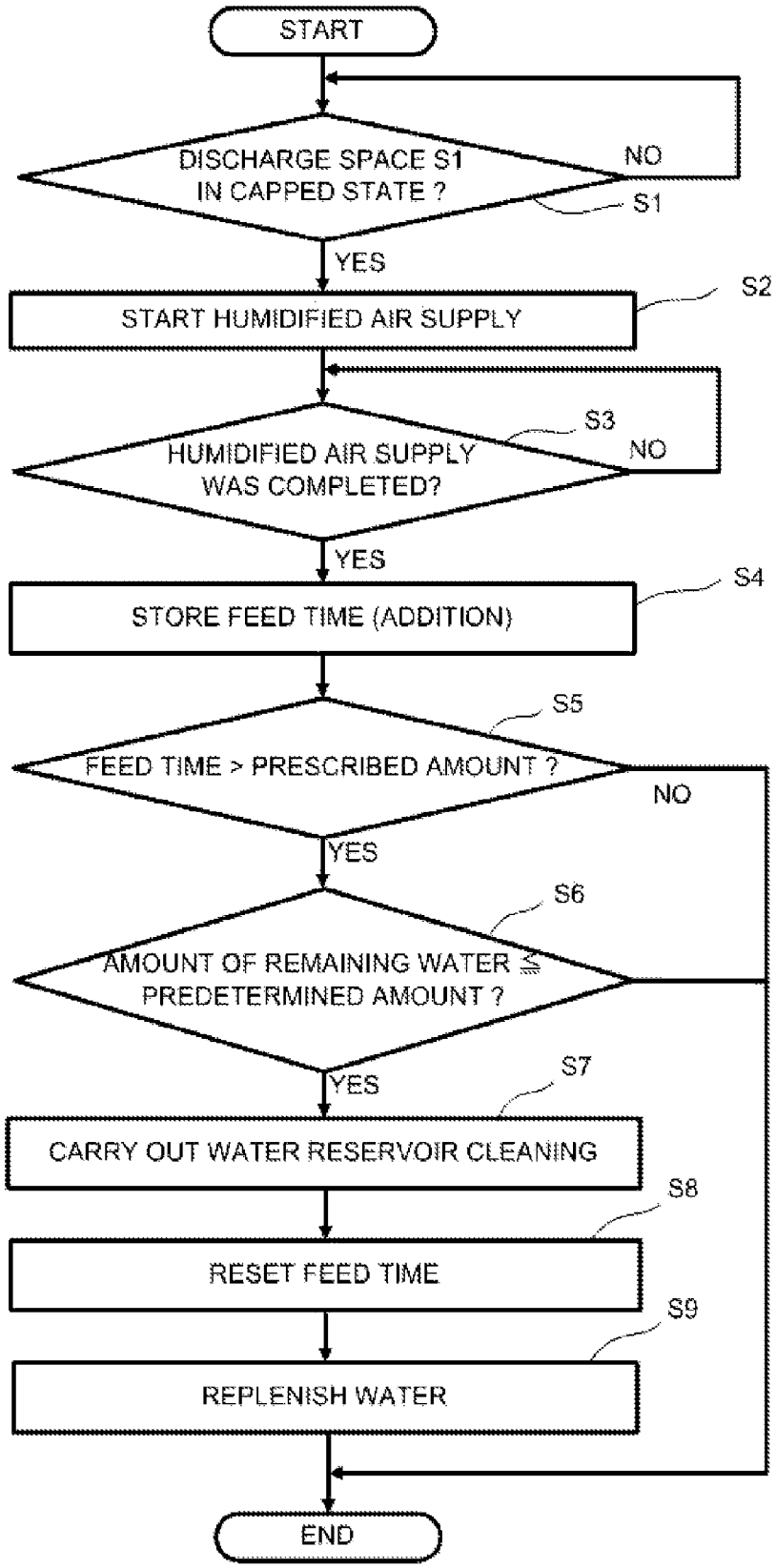
FIG. 9 illustrates, in a flowchart, method steps of the inkjet printer according to the embodiment of the present invention.

In the present embodiment, the exhaust determination unit 64*b* determines, with reference to the humidification history storage unit 64*a*, that the amount of the non-volatile component included in water is greater than a prescribed amount each time a predetermined amount of the humidified air is supplied; however, whether the amount of the non-volatile component included in water is greater than a prescribed amount may be determined by other methods. For example, as illustrated in FIG. 9, when the amount of remaining water detected by the water level sensor 59*a* decreases to or below a predetermined amount (YES at S21 in FIG. 11), a maintenance control unit 164 controls the replenishing mechanism 59 such that water is replenished to the water reservoir 54 (S22). The amount of water replenished in the water reservoir 54 by the replenishing mechanism 59 is stored in a replenishment history storage unit 164*a* (S23). An exhaust determination unit 154*b* may determine, with reference to the replenishment history storage unit 164*a*, whether the amount of the non-volatile component is greater than a prescribed amount in accordance with the total amount of water replenished in the water reservoir 54 (YES at S24). Therefore, the amount of the non-volatile component can be detected correctly. Water reservoir cleaning is performed to exhaust the non-volatile component in the water reservoir 54 with water after the exhaust determination unit 64*b* determines that the amount of the non-volatile component is greater than a prescribed amount in accordance with the total amount of water replenished in the water reservoir 54 (S25). After water reservoir cleaning is completed, the amount of water replenished which is stored in a replenishment history storage unit 164*a* is reset (S26), and replenishment of water is performed by the replenishing mechanism 59 (S27).

Also, when the amount of remaining water detected by the water level sensor 59*a* decreases to or below a predetermined amount, a maintenance control unit 164 controls the replenishing mechanism 59 such that a predetermined amount of water is replenished to the water reservoir 54. The number of water replenishments of the water reservoir 54 by the replenishing mechanism 59 is stored in a replenishment history storage unit 164*a*. An exhaust determination unit 154*b* may determine, with reference to the replenishment history storage unit 164*a*, whether the amount of the non-volatile component is greater than a prescribed amount in accordance with the total amount of water replenished in the water reservoir 54. Therefore, the amount of the non-volatile component can be detected correctly.

Another Modification

Figure 12:
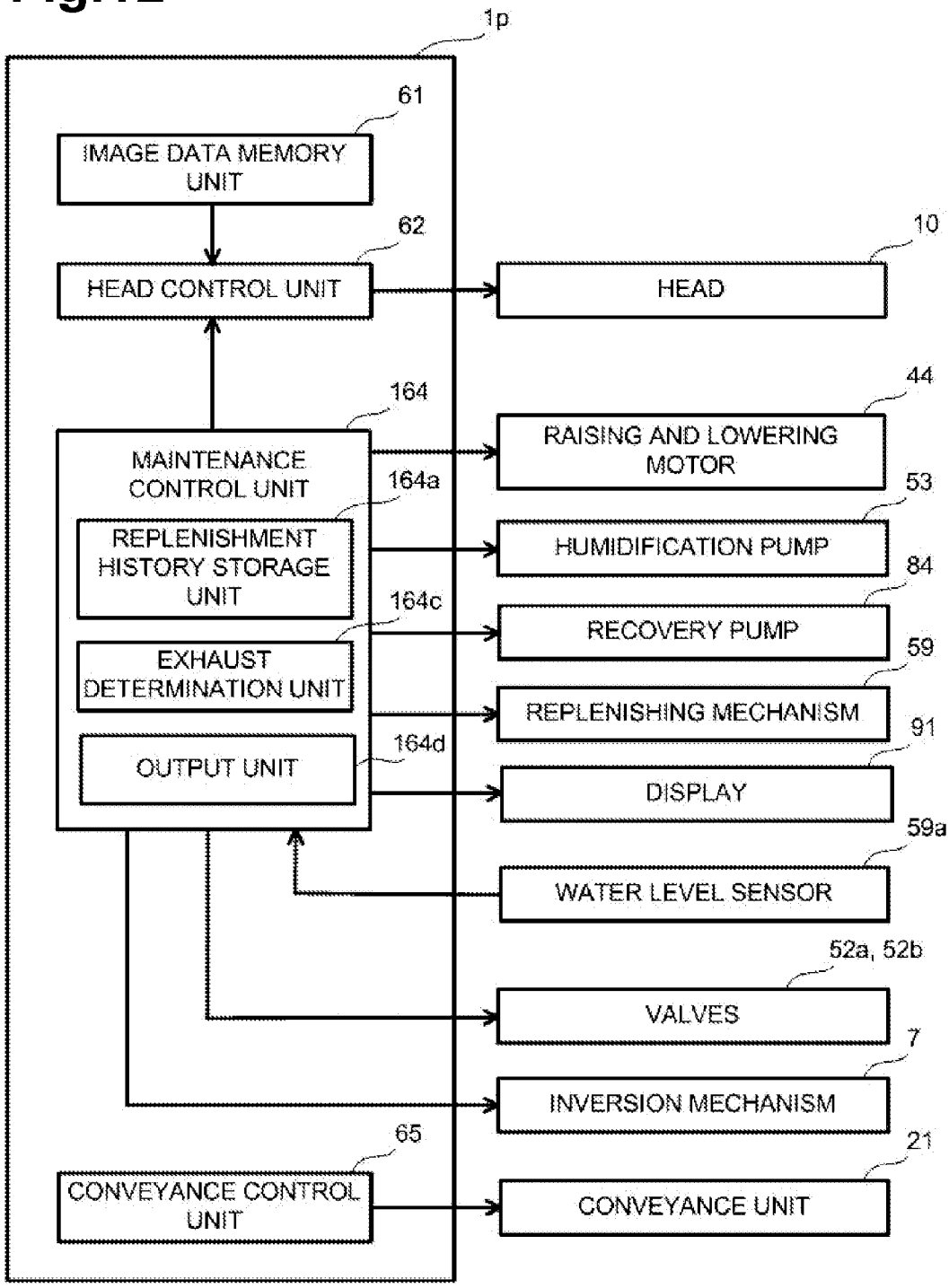
FIG. 12 illustrates, in a functional block diagram, another modification of the present invention.
Figure 13:
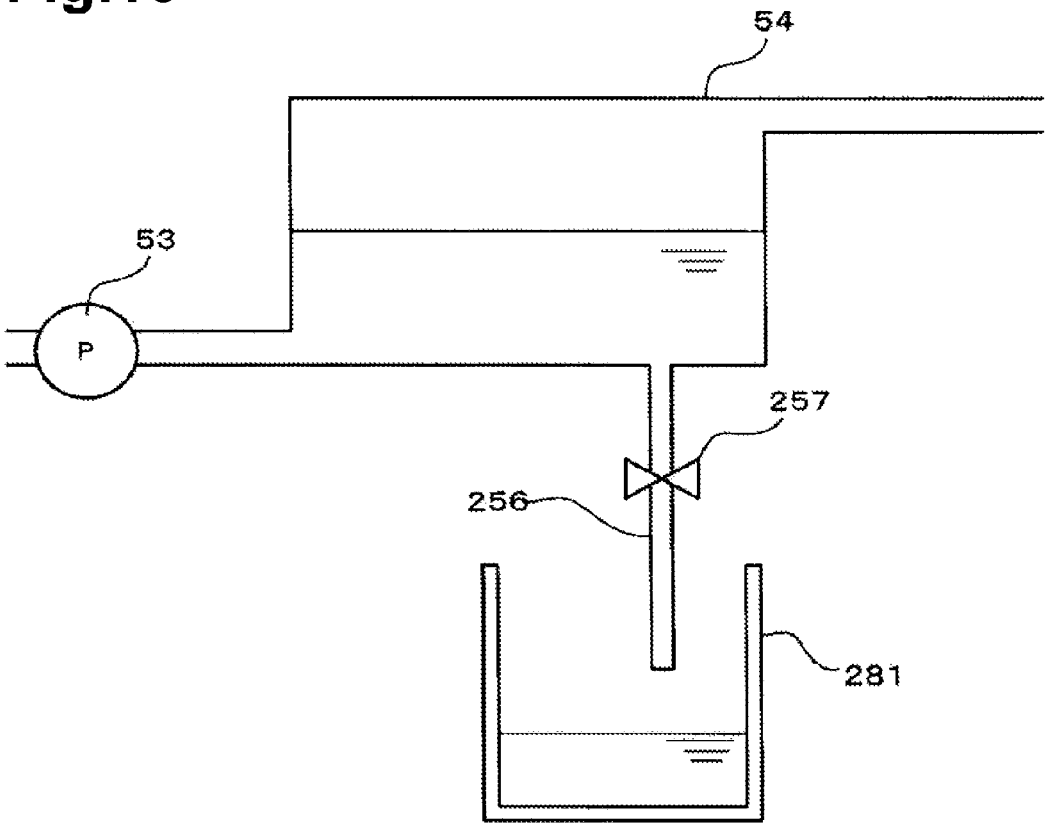
FIG. 13 illustrates, in a schematic block diagram, another modification of the present invention.
Figure 14:
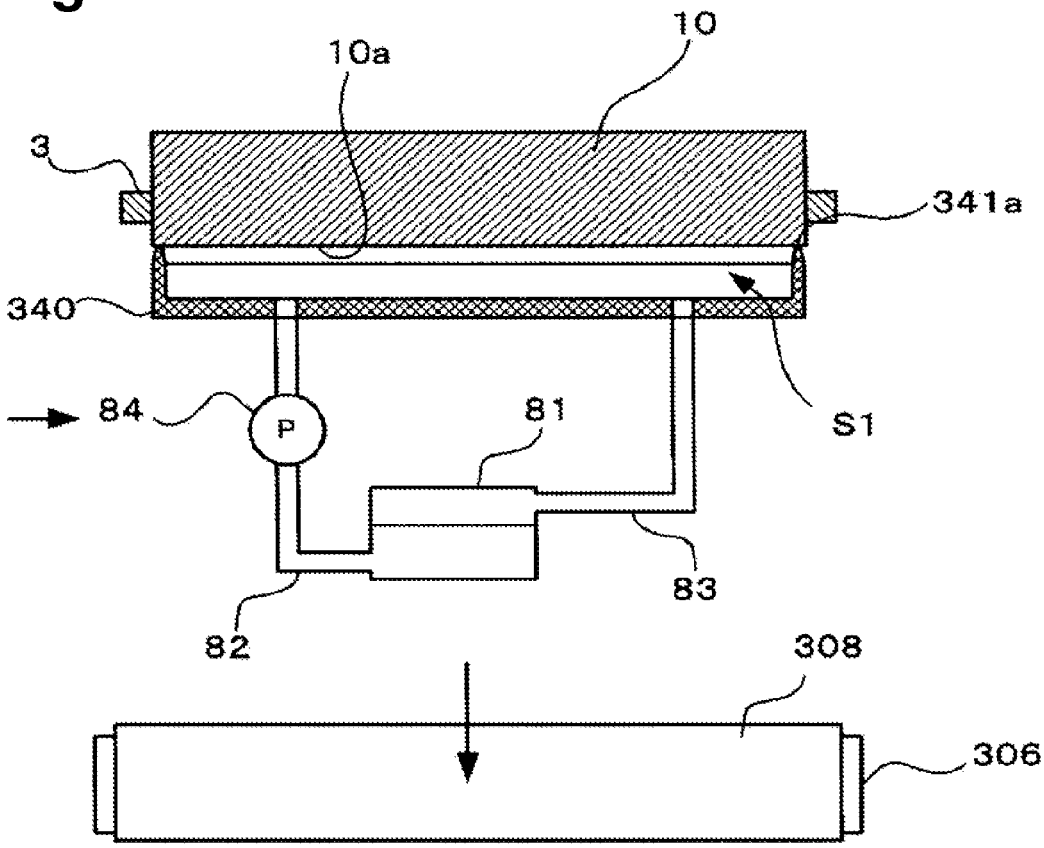
FIG. 14 illustrates, in a schematic block diagram, a further modification of the present invention.
Figure 15:
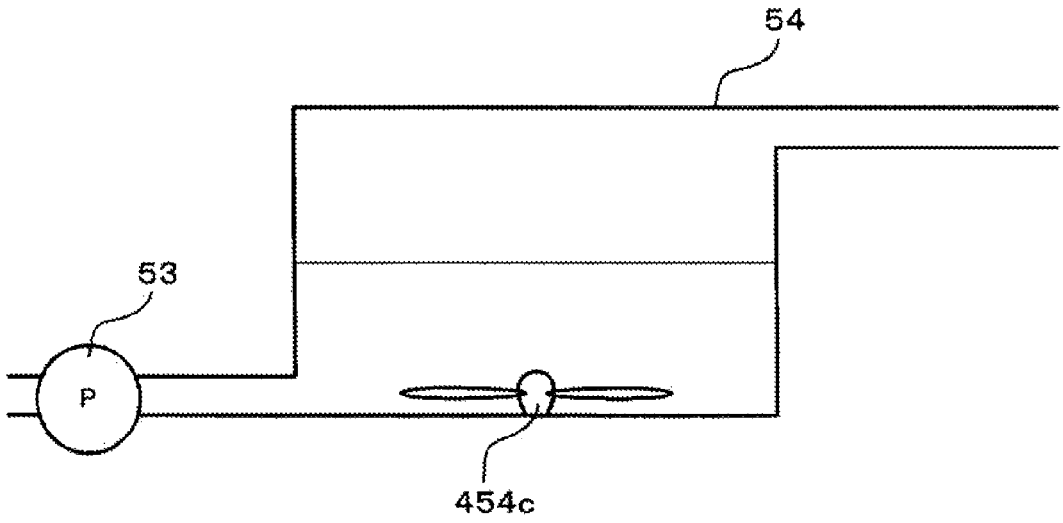
FIG. 15 illustrates, in a schematic block diagram, an even further modification of the present invention.

In the present embodiment, water reservoir cleaning is performed to exhaust the non-volatile component in the water reservoir 54 with water after the exhaust determination unit 64*b* determines that the amount of the non-volatile component in the antiseptic agent stored in the water reservoir 54 is greater than a prescribed amount; however, the controller 1*p* may output a message which indicates the amount of the non-volatile component is greater than the predetermined amount before water reservoir cleaning is performed. For example, as illustrated in FIG. 12, when the exhaust determination unit 64*b* determines that the amount of the non-volatile component is greater than a prescribed amount in accordance with the total amount of water replenished in the water reservoir 54, an output unit 164*d* output a message to a display 91 which is fixed on the housing 1*a*. Information on the printer which needs the water reservoir cleaning is included in the message, such that a user looking at the message displayed on the display can know the reason or necessity for the water reservoir cleaning. And the user can perform the water reservoir cleaning by operating an exhaust valve 257 (see FIG. 13) manually. In addition, when there is no exhaust valve 257, the user removes the water reservoir 54 and can perform the water reservoir cleaning.

Although preferred embodiments of the present invention have been described above, the present invention is not limited to the same. Various design changes may be made. For example, in the embodiments described above, water reservoir cleaning is started after it is determined that the amount of the non-volatile component is greater than a prescribed amount and immediately before replenishment of water by the replenishing mechanism 59 is started in response that the amount of the remaining water in the water reservoir 54 decreases to or below a predetermined amount. However, water reservoir cleaning may be started at any time once it is determined that the amount of the non-volatile component is greater than a prescribed amount. For example, water reservoir cleaning may be started immediately after it is determined that the amount of the non-volatile component is greater than a prescribed amount. Alternatively, water reservoir cleaning may be started after a certain period of time elapsed after it is determined that the amount of the non-volatile component is greater than a prescribed amount (for example, at the next water supply event).

In the embodiments described above, the exhaust determination unit 64*b* (164*c*) determines, with reference to the humidification history storage unit 64*a* or the replenishment history storage unit 164*a*, that the amount of the non-volatile component included in water is greater than a prescribed amount. However, the amount of the non-volatile component included in the water may be measured by measuring directly a refractive index or a electrical resistance of the water in the water reservoir 54 by a sensor for determining the amount of the non-volatile component. In this case, the exhaust determination unit 64*b* (164*c*) unit determines that the amount of the non-volatile component included in water is greater than a prescribed amount, when the concentration of the non-volatile component included in water is greater than a prescribed concentration value.

Figure 10:
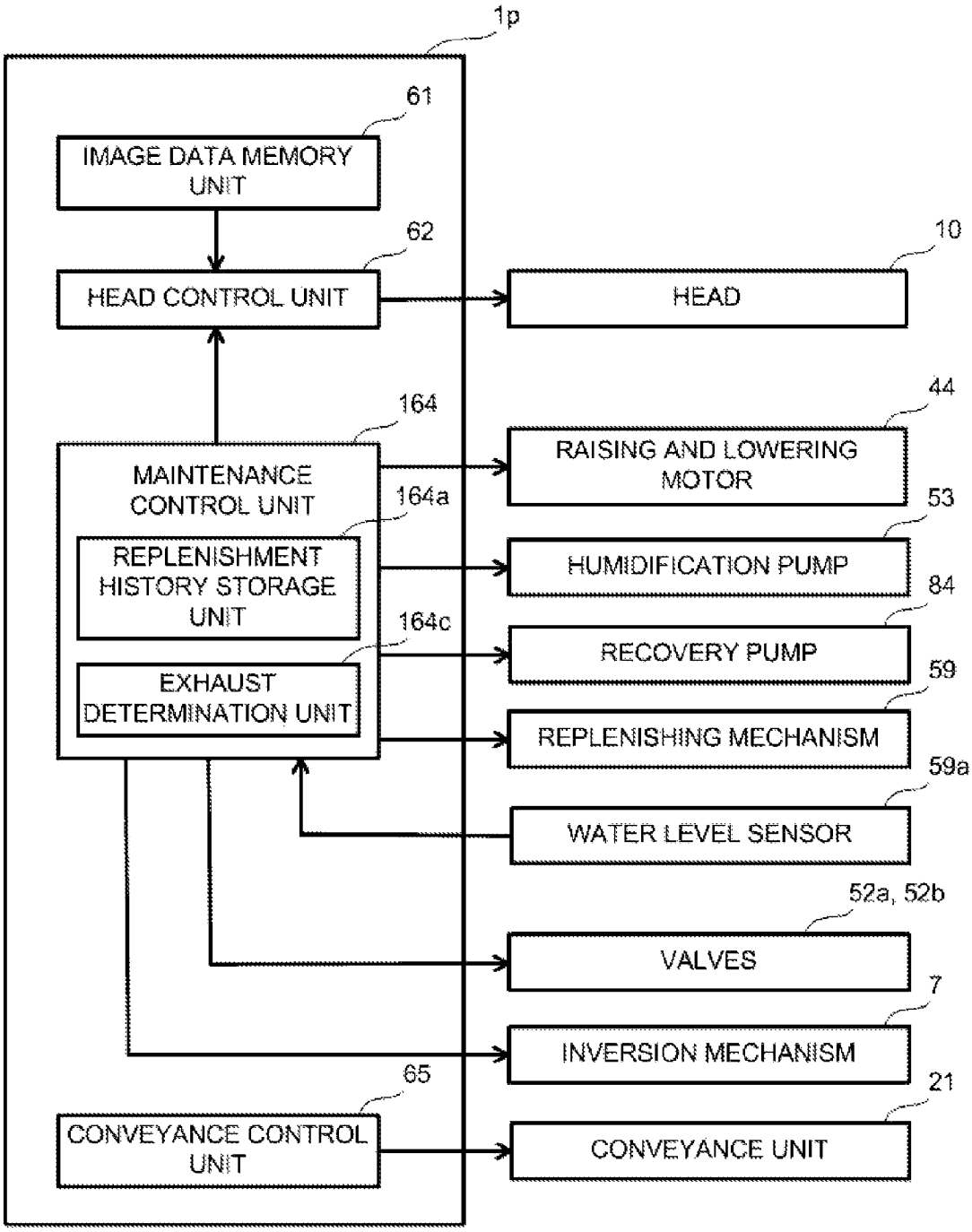
FIG. 10 illustrates, in a functional block diagram, a modification of the present invention.

In the embodiments described above, water in the water reservoir 54 is exhausted through the upstream outlet 54*a*; but water in the water reservoir 54 may be exhausted through an exhaust passage 256 formed in the water reservoir 54 as illustrated in FIG. 10. In this case, an exhaust valve 257 provided in the exhaust passage 256 is controlled by the maintenance control unit 64 and water in the water reservoir 54 is exhausted into a waste water reservoir 281 through an opening exhaust valve 257.

In the embodiments described above, the upstream outlet 54*a* is provided near the bottom surface of the water reservoir 54; but the upstream outlet may be provided at any other position as long as it is in contact with water.

In the embodiments described above, the total amount of the non-volatile component in the water reservoir 54 is exhausted, because the water reservoir 54 is emptied. However, alternatively, an amount of water may be exhausted so that there is remaining water in the water reservoir 54 which is taken into consideration by the exhaust determination unit 64*b*.

In the embodiments described above, a circulating channel through which the humidified air circulates is formed for humidification maintenance; but it is not always necessary to let humidified air exhausted into the discharge space circulate.

In the embodiments described above, the tube 83 is in communication with the discharge space S1; but it is not always necessary to provide the tube 83. In this case, the discharge space S1 is made to communicate with ambient air at the recovery of the exhausted water to thereby achieve suitable recovery of exhausted water.

In the embodiments described above, humidified air is produced by compulsorily supplying air through the upstream outlet 54*a* which is in contact with water in the water reservoir 54; but humidified air may be produced by other mechanisms. For example, humidified air may be produced by heating water with a heater. That is, humidified air may be produced by any mechanisms with which the non-volatile component deposits on the water reservoir 54.

It is not always necessary that the protrusion 41*a* is movable as in the embodiments described above. For example, the protrusion may be fixed to a head holder in a non-movable manner and a relative position of the end of the protrusion to the discharge surface may be constant. In this case, the protrusion may be selectively located at a contact position and a separated position by raising or lowering the head holder or the support surface of a medium support so as to change the relative position of the protrusion to the discharge surface.

Figure 11:
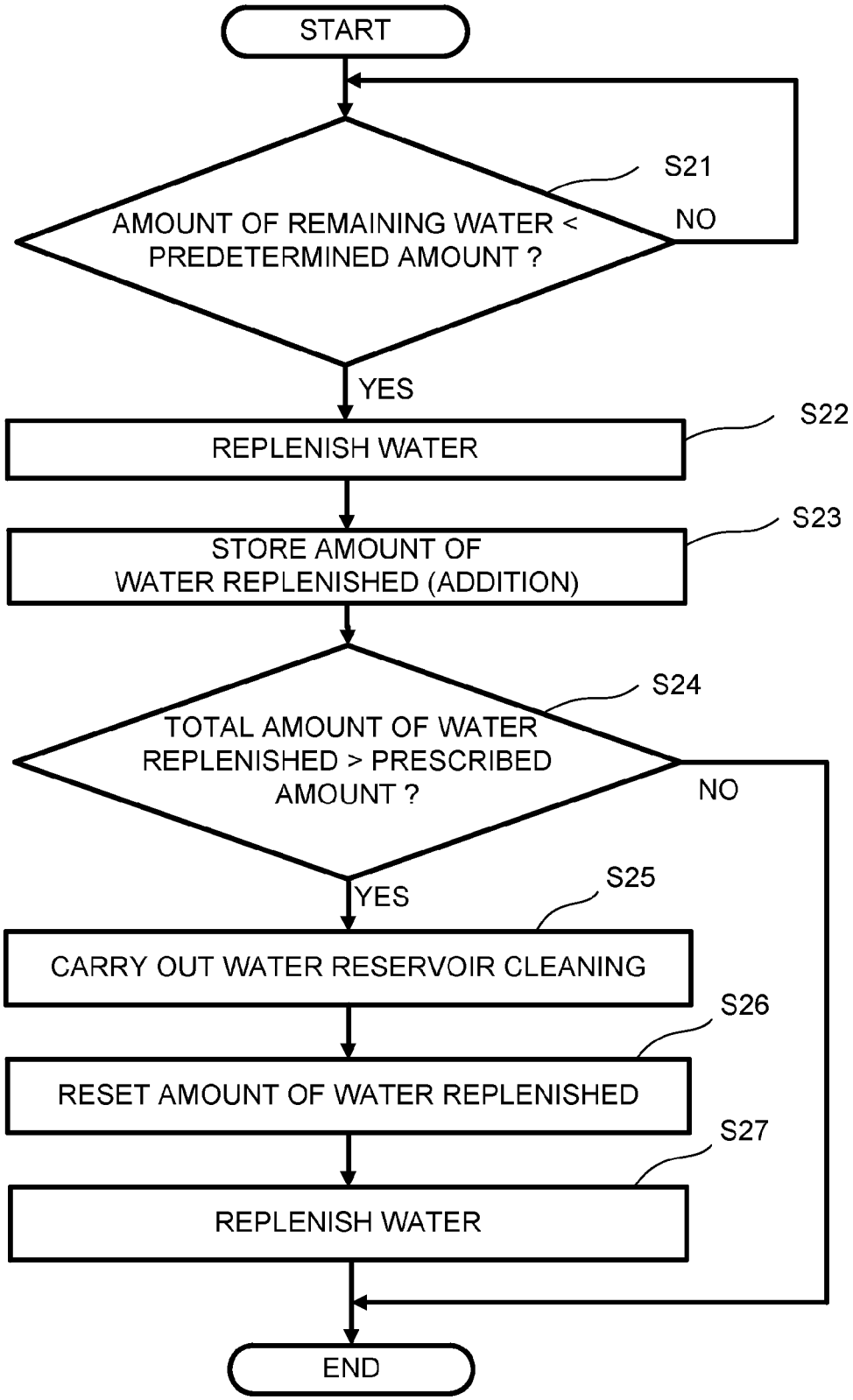
FIG. 11 illustrates, in a flowchart, method steps of the inkjet printer according to a modification of the present invention.

As illustrated in FIG. 11, the cap 340 may be provided separately from the head 10. In this case, the cap 340 may be located at a position at which it faces the discharge surfaces 10*a* after the conveyance unit is moved downward. A seamless conveyor belt may be used in the conveyance unit. The cap 340 may be selectively located at a contact position and a separated position by raising or lowering at least one of the head 10 and the cap 340: at the contact position, an end 341*a* of the cap 340 is in contact with the discharge surfaces 10*a*; at the separated position, the end 341*a* is separated from the discharge surfaces 10*a*. When cap 340 is at the contact position, the discharge space S201 is sealed by the cap 340 (a capped state). When the cap 340 is at the separated position, the discharge space S201 is opened (a non-capped state). In the structure of FIG. 11, the humidification mechanism 50 may be provided at the cap 340. In this case, when the humidification pump 53 is driven to rotate backward to exhaust water stored in the water reservoir 54 into the cap 340, the exhausted water easily flows into the tube 57. Thus, the opening 51*b* is effectively closed. In this case, interference in driving of the humidification pump 53 at the time that the humidification pump 53 is driven to rotate backward should be prevented by, for example, opening an ambient air communication valve (not illustrated) provided at an upper position of the water reservoir 54 and introducing ambient air to replace the air exhausted from the water reservoir 54 with.

In the embodiments described above, in water reservoir cleaning, the humidification pump 53 is driven to rotate forward immediately before the non-volatile component is exhausted with water such that air is compulsorily supplied to the water reservoir 54 and agitates water. It is also possible to agitate water by an agitating mechanism 454*c*, such as a propeller, which is provided inside the water reservoir 54 as illustrated in FIG. 12. According to this, water can be agitated reliably.

The inlet and the outlet of the circulation channel may be of any shape and may be located at any position as long as they are formed at the head, the head holder or the cap and communicate with the discharge space. For example, one of the inlet and the outlet may be formed at the head and the other may be formed at the head holder. The inlet or the outlet may be formed at the protrusion of the cap. It is also possible that no recess 3*x* is formed on a surface of the head or the head holder, but the inlet and/or outlet of the circulation channel may be located on the same level as the discharge surfaces 10*a*. The inlet and outlet may be located at positions on both sides of the discharge surfaces 10*a* (or a group of discharge outlets if the inlet and/or outlet is formed at the head) along the sub-scanning direction when seen in a plan view. Alternatively, the inlet and outlet may be located at positions on the same sides of the discharge surfaces 10*a* (i.e., positions on the same sides with respect to the discharge surface 10*a*) which does not sandwich when seen in a plan view.

In the embodiment described above, a component in an antiseptic agent is described as an example of the non-volatile component; but any type of non-volatile components may be used as long as they are deposited in the water reservoir 54 and cause deterioration in humidifying function.

The present invention is applicable to a line printer and a serial printer, and is also applicable to a facsimile machine, a copy machine and other devices. The apparatus of the present invention may discharge any liquid other than ink.

What is claimed is:

1. A liquid discharge apparatus comprising:

a liquid discharge head which includes a discharge surface forming a plurality of discharge outlets for discharging a liquid, a discharge space being defined facing the discharge surface;

a cap unit configured to be in a sealed state in which the cap unit seals the discharge space to an external space, and a non-sealed state in which the cap unit does not seal the discharge space to the external space;

a humidification mechanism comprising:

a humidifier liquid reservoir configured to store an externally supplied humidifier liquid including a non-volatile component; and a humidified air supply unit configured to supply humidified air humidified by a humidifier liquid stored in the humidifier liquid reservoir to the discharge space when it is in the sealed state;

a determination unit configured to determine whether an amount of the non-volatile component in the humidifier liquid stored in the humidifier liquid reservoir is greater than a predetermined amount.

2. The liquid discharge apparatus according to claim 1, wherein the discharge surface is opposite a support surface, the discharge space being between the discharge surface and the support surface.

3. The liquid discharge apparatus according to claim 2, wherein the support surface is a surface of a glass table.

4. The liquid discharge apparatus according to claim 1, further comprising an exhaust unit configured to exhaust at least a part of the humidifier liquid stored in the humidifier liquid reservoir when the determination unit determined that the amount of the non-volatile component is greater than the predetermined amount.

5. The liquid discharge apparatus according to claim 1, wherein the determination unit determines whether the amount of the non-volatile component is greater than the predetermined amount each time the humidified air supply unit supplies a predetermined amount of humidified air.

6. The liquid discharge apparatus according to claim 1, wherein the humidified air supply unit includes a pump configured to supply air to the humidifier liquid reservoir, the determination unit determines whether the amount of the non-volatile component is greater than the predetermined amount by detecting a drive time of the pump.

7. The liquid discharge apparatus according to claim 1, further comprising a replenishment unit configured to replenish humidifier liquid in the humidifier liquid reservoir, wherein the determination unit determines whether the amount of the non-volatile component is greater than a predetermined value with reference to the total amount of the humidifier liquid replenished by the replenishment unit.

8. The liquid discharge apparatus according to claim 4, wherein the exhaust unit is configured to exhaust the humidifier liquid stored in the humidifier liquid reservoir before supply of the humidifier liquid by the replenishment unit is started.

9. A liquid discharge apparatus according to claim 4, wherein the humidifier liquid reservoir includes an exhaust outlet, and the exhaust unit being configured to exhaust the humidifier liquid stored in the humidifier liquid reservoir through the exhaust outlet.

10. The liquid discharge apparatus according to claim 1, wherein: the humidified air supply unit includes an inlet and an outlet which communicate with the discharge space, the humidified air supply unit being configured to let the humidified air flow into the discharge space through the inlet and let the humidified air flow out of the discharge space return to the humidifier liquid reservoir through the outlet, when the cap unit is in the sealed state.

11. The liquid discharge apparatus according to claim 1, wherein:

the humidifier liquid reservoir includes an upstream outlet which is in contact with the stored humidifier liquid and a downstream outlet which is not in contact with the humidifier liquid; and the humidification mechanism includes a pump configured to supply air to the humidifier liquid reservoir through the upstream outlet such that the humidified air is exhausted through the downstream outlet.

12. The liquid discharge apparatus according to claim 11, further comprising an exhaust unit configured to exhaust at least a part of the humidifier liquid stored in the humidifier liquid reservoir when the determination unit determined that the amount of the non-volatile component is greater than the predetermined amount, wherein the exhaust unit drives the pump such that humidifier liquid stored in the humidifier liquid reservoir is exhausted through the upstream outlet.

13. The liquid discharge apparatus according to claim 11, further comprising an exhaust unit configured to exhaust at least a part of the humidifier liquid stored in the humidifier liquid reservoir when the determination unit determined that the amount of the non-volatile component is greater than the predetermined amount, wherein the pump supplies air to the humidifier liquid reservoir before the humidifier liquid stored in the humidifier liquid reservoir is exhausted by the exhaust unit.

14. The liquid discharge apparatus according to claim 1, further comprising an exhaust unit configured to exhaust at least a part of the humidifier liquid stored in the humidifier liquid reservoir when the determination unit determined that the amount of the non-volatile component is greater than the predetermined amount and an agitation unit being configured to agitate the humidifier liquid stored in the humidifier liquid reservoir before the humidifier liquid stored in the humidifier liquid reservoir is exhausted by the exhaust unit.

15. The liquid discharge apparatus according to claim 1, further comprising a output unit configured to output a message when the determination unit determines that the amount of the non-volatile component is greater than the predetermined amount.

16. A method for a liquid discharge apparatus comprising:

a liquid discharge head which includes a discharge surface forming a plurality of discharge outlets for discharging a liquid, a discharge space being defined facing the discharge surface;

a cap unit configured to be in a sealed state in which the cap unit seals the discharge space to an external space, and a non-sealed state in which the cap unit does not seal the discharge space to the external space; and a humidification mechanism comprising:

a humidifier liquid reservoir configured to store an externally supplied humidifier liquid including a non-volatile component; and a humidified air supply unit configured to supply humidified air humidified by a humidifier liquid stored in the humidifier liquid reservoir to the discharge space when it is in the sealed state, the method comprising the steps of:

storing an amount of the non-volatile component in the humidifier liquid stored in the humidifier liquid reservoir; and determining whether the amount of the non-volatile component in the humidifier liquid stored in the humidifier liquid reservoir is greater than a predetermined amount.

* * * * *